US012613065B2

(12) United States Patent
Pomorski et al.

(10) Patent No.: US 12,613,065 B2
(45) Date of Patent: Apr. 28, 2026

(54) ETHANE SEPARATION WITH OVERHEAD CRYOGENIC HEAT EXCHANGER

(71) Applicant: UOP LLC, Des Plaines, IL (US)

(72) Inventors: Glen John Pomorski, Park Ridge, IL (US); Kyle Cuellar, Fulshear, TX (US); Joseph Edward Zimmermann, Arlington Heights, IL (US); Dennis Robert Ladendorf, Carpentersville, IL (US); Michael R. Van de Cotte, Palatine, IL (US)

(73) Assignee: UOP LLC, Rosemont, IL (US)

( * ) Notice: Subject to any disclaimer, the term of this patent is extended or adjusted under 35 U.S.C. 154(b) by 225 days.

(21) Appl. No.: 18/530,954

(22) Filed: Dec. 6, 2023

(65) Prior Publication Data

US 2024/0191941 A1 Jun. 13, 2024

Related U.S. Application Data

(60) Provisional application No. 63/386,610, filed on Dec. 8, 2022.

(51) Int. Cl.
*F25J 3/02* (2006.01)

(52) U.S. Cl.
CPC ..... *F25J 3/0242* (2013.01); *F25J 3/0219* (2013.01); *F25J 3/0238* (2013.01); *F25J 2200/06* (2013.01); *F25J 2215/62* (2013.01); *F25J 2215/64* (2013.01); *F25J 2260/60* (2013.01); *F25J 2270/14* (2013.01)

(58) Field of Classification Search
CPC .. F25J 3/02; F25J 3/0242; F25J 3/0238; F25J 2200/06; F25J 2215/62
See application file for complete search history.

(56) References Cited

U.S. PATENT DOCUMENTS

| | | | | |
|---|---|---|---|---|
| 4,720,293 | A | 1/1988 | Rowles et al. | |
| 6,405,561 | B1 * | 6/2002 | Mortko | F25J 3/0242 62/631 |
| 11,643,378 | B2 | 5/2023 | Zhu et al. | |
| 2002/0042550 | A1 | 4/2002 | Pironti et al. | |
| 2013/0213087 | A1 * | 8/2013 | Currence | F25J 3/0233 62/621 |
| 2020/0109893 | A1 * | 4/2020 | Ducote, Jr. | F25J 3/0645 |
| 2020/0116427 | A1 | 4/2020 | Bauer et al. | |
| 2021/0148632 | A1 * | 5/2021 | Ducote, Jr. | F25J 3/0645 |
| 2022/0316798 | A1 | 10/2022 | Cuellar et al. | |

FOREIGN PATENT DOCUMENTS

| | | | | |
|---|---|---|---|---|
| CN | 111763131 A | 10/2020 | | |
| WO | WO-9961852 A1 * | 12/1999 | | F25J 3/0242 |

OTHER PUBLICATIONS

U.S. Appl. No. 18/510,371, filed Nov. 15, 2023.
"Search Report and Written Opinion for PCT/US2023/083170 dated", Apr. 24, 2024.

* cited by examiner

*Primary Examiner* — William C Doerrler
(74) *Attorney, Agent, or Firm* — Paschall & Associates, LLC; James C. Paschall

(57) ABSTRACT

An improved process and apparatus integrate a deethanizer column with a cryogenic heat exchanger by condensing the deethanizer column overhead with a refrigerant stream in a cryogenic heat exchanger. A refrigerant compressor may provide refrigerant to the deethanizer overhead cryogenic condenser and a main cryogenic heat exchanger. Expansion of the refrigerant may provide sufficient cooling duty in one or both cryogenic exchangers.

14 Claims, 1 Drawing Sheet

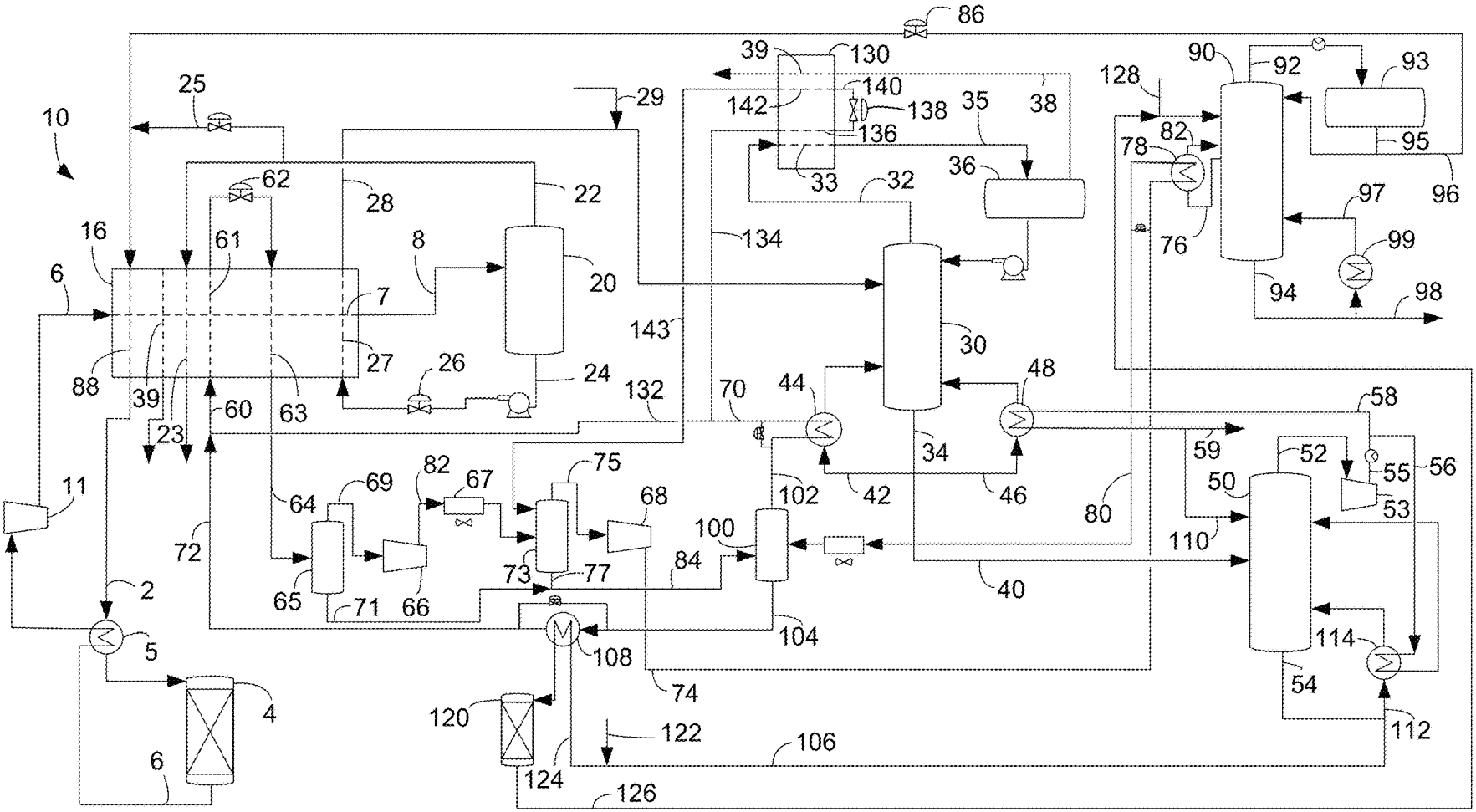
10
11
16
88
6
25
62
61
23
39
60
72
2
5
4
6
120
124
126
122
108
74
106
104
102
100
84
70
143
132
134
142
39
130
140
136
138
86
33
32
35
38
36
30
34
46
48
40
42
44
80
128
78
82
76
90
92
94
95
93
96
97
99
98
58
56
55
53
52
54
50
59
110
112
114
29
22
20
24
8
26
28
7
27
63
64
65
69
71
66
67
82
68
75
77
73

ETHANE SEPARATION WITH OVERHEAD CRYOGENIC HEAT EXCHANGER

FIELD

The field relates to separation of hydrogen and light hydrocarbons at cryogenic temperatures. More particularly, the field relates to propylene recovery from light hydrocarbons.

BACKGROUND

Dehydrogenation of hydrocarbons is an important commercial hydrocarbon conversion process because of the existing and growing demand for dehydrogenated hydrocarbons for the manufacture of various chemical products such as detergents, high octane gasolines, oxygenated gasoline blending components, pharmaceutical products, plastics, synthetic rubbers, and other products. In particular, demand for propylene in the petrochemical industry has grown substantially due to its use as a precursor in the production of polypropylene for packaging materials and other commercial products. Other downstream uses of propylene include the manufacture of acrylonitrile, acrylic acid, acrolein, propylene oxide and glycols, plasticizer oxo alcohols, cumene, isopropyl alcohol, and acetone. One route for producing propylene is the dehydrogenation of propane.

A process for the conversion of paraffins to olefins involves passing a paraffin feed stream over a highly selective catalyst, where the paraffin is dehydrogenated to the corresponding olefin producing a dehydrogenation reactor effluent. Cooling and separation of the dehydrogenation reactor effluent into a hydrocarbon-rich fraction and a hydrogen-rich vapor fraction, part of which is non-recycled net gas, is provided in a cryogenic separation system that requires refrigeration for cooling the process streams in order to separate hydrogen from light hydrocarbon liquid. The conventional cryogenic separation system cools process streams alone to remove hydrogen from light hydrocarbon. However, further fractionation is needed to separate the C2− material from the C3 hydrocarbons in the dehydrogenation effluent in a deethanizer column which also typically requires a refrigeration package.

Improvements in cryogenic separation systems are necessary to render propylene production and purification more economical.

SUMMARY

We have discovered an improved process and apparatus that integrate a deethanizer column with a cryogenic heat exchanger by condensing the deethanizer column overhead with a refrigerant stream in a cryogenic heat exchanger. A refrigerant compressor may provide refrigerant to the deethanizer overhead cryogenic condenser and a main cryogenic heat exchanger.

These and other features, aspects, and advantages of the present disclosure are further explained by the following detailed description, drawing and appended claims.

BRIEF DESCRIPTION OF THE DRAWING

The FIGURE is a schematic representation of the process and apparatus of the present disclosure.

DEFINITIONS

The following detailed description is merely exemplary in nature and is not intended to limit the application and uses of the embodiment described. Furthermore, there is no intention to be bound by any theory presented in the preceding background or the following detailed description.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant" or "predominate" means greater than 50%, suitably greater than 75% and preferably greater than 90%.

The term "$C_x$" is to be understood to refer to molecules having the number of carbon atoms represented by the subscript "x". Similarly, the term "$C_x$−" refers to molecules that contain less than or equal to x and preferably x and less carbon atoms. The term "$C_x$+" refers to molecules with more than or equal to x and preferably x and more carbon atoms.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Unless otherwise indicated, overhead lines and bottom lines refer to the net lines from the column downstream of the reflux or reboil to the column. Alternatively, a stripping stream may be used for heat input near the bottom of the column.

As used herein, the term "a component-rich stream" means that the rich stream coming out of a vessel has a greater concentration of the component than the feed to the vessel.

As used herein, the term "a component-lean stream" means that the lean stream coming out of a vessel has a smaller concentration of the component than the feed to the vessel.

DETAILED DESCRIPTION

The disclosure is a process and apparatus which integrates the separation of hydrogen, C2− hydrocarbons and C3+ hydrocarbons into a single system with a single refrigeration package. A single refrigerant system is used to facilitate cooling and condensation at a wide temperature range. The process and apparatus utilize two cryogenic heat exchangers one on an overhead of and the other on the feed to a deethanizer column, eliminates the use of steam for reboiling and utilizes the refrigeration system in the cryogenic heat exchanger to reduce the fractionation costs substantially. The process and apparatus permit use of a single deethanizer column instead of the conventional two deethanizer columns which reduces capital expense and operational complexity. The process and apparatus provide for reduced compressor stages, equipment count, and utility usage.

The process and apparatus comprise passing a reactor feed stream comprising hydrocarbons and hydrogen in a reactor feed line 2 to a dehydrogenation reactor 4 to provide a dehydrogenation reactor effluent stream in an effluent line 6. The reactor feed stream in line 2 may be pre-heated in a hot combined feed exchanger 5 before it passes to the dehydrogenation reactor 4.

The reactor feed stream comprises propane. In some embodiments, the reactor feed stream comprises other light paraffins such as ethane, butane, normal butane, isobutane, pentane or iso-pentane. In some embodiments, the reactor feed stream comprises at least one paraffin having 2 to 30 carbon atoms. The hydrogen-to-hydrocarbon molar ratio of the feed stream is in a range of 0.005 to 0.6.

The pre-heated reactor feed stream is contacted with a dehydrogenation catalyst in the dehydrogenation reactor 4 maintained at dehydrogenation conditions to produce a dehydrogenation reactor effluent stream comprising hydrogen, unconverted paraffins, and olefins in an effluent line 6. The dehydrogenation reactor 4 may be a reaction zone that includes multi-stages or multiple reactors, often in series.

The dehydrogenation catalyst may be a highly selective platinum-based catalyst system. One example of a suitable catalyst for a light paraffin dehydrogenation process may be a catalyst composite comprising a Group VIII noble metal component, a Group IA or IIA metal component, and a component selected from the group consisting of tin, germanium, lead, indium, gallium, thallium, or mixtures thereof, all on an alumina support.

Dehydrogenation conditions include a temperature of from about 400° to about 900° C., a pressure of from about 0.01 to about 10 atmospheres absolute, and a liquid hourly space velocity (LHSV) of from about 0.1 to about 100 $hr^{-1}$. Generally, for normal paraffins, the lower the molecular weight, the higher the temperature required for comparable conversion. The pressure in the dehydrogenation reactor 4 is maintained as low as practicable, consistent with equipment limitations, to maximize the chemical equilibrium advantages. The dehydrogenation reaction is typically endothermic.

The reactor feed stream in the reactor feed line 2 may be heat exchanged with the reactor effluent stream in line 6 in the hot combined feed exchanger 5. The dehydrogenation reactor effluent stream in line 6 is cooled by heat exchange with the reactor feed stream 2 in the hot combined feed exchanger 5 and compressed in a reactor effluent compressor 11 to provide a compressed reactor effluent stream. The compressed reactor effluent stream in the reactor effluent line 6 is passed to a cryogenic separation system 10 to provide an olefin stream and a hydrogen stream.

The reactor effluent stream may comprise light hydrocarbons and hydrogen. In paraffin dehydrogenation, the desired product is often propylene which must be separated from other light hydrocarbons such as propane and hydrogen. Propane can be recycled to the dehydrogenation reactor 4 for propylene production. Hydrogen is a valuable byproduct and may be used elsewhere in the refinery such as for fuel for fired heaters of a dihydrogen process. Some hydrogen may be recycled back to the reactor 4 to control the dehydrogenation reaction.

To separate the hydrogen from the light hydrocarbons effectively, the reactor effluent stream is cooled by passing it to a main cryogenic heat exchanger 16 to condense the hydrocarbons. In the main cryogenic heat exchanger 16, the reactor effluent stream in line 6 is routed through an effluent pass 7 in which it is cooled by heat exchange with other streams passing through the cryogenic heat exchanger to provide a cooled reactor effluent stream in line 8. The main cryogenic heat exchanger 16 may be in downstream communication with the dehydrogenation reactor 4.

A single-stage separator 20 is in downstream communication with the effluent pass 7. The cooled reactor effluent stream in line 8 is separated in a single-stage separator 20 to provide a net gas overhead stream rich in hydrogen in a separator overhead line 22 extending from an overhead of the single-stage separator and a separator bottoms stream rich in hydrocarbons in a separator bottoms line 24 extending from a bottom of single-stage the separator. The single-stage separator 20 may operate at a temperature between about −150° C. (−101° F.) and about 66° C. (150° F.) and more commonly between about −95° C. (−138° F.) and about −40° C. (−40° F.), and a gauge pressure between about 690 kPa (100 psig) and about 1.4 MPa (200 psig). The temperature and pressure of the single stage separator 20 may be adjusted to maximize the recovery of the desired product propylene as well as propane in the separator liquid line 24. The recovery of propylene and propane in the separator liquid stream 24 as a percent of the total amount of propylene and propane in the reactor effluent line 8 may be between 90 and 100%, and preferably at least 99.5% and more preferably between 99.6 and 99.8%.

The net gas overhead stream in the separator overhead line 22 is sufficiently hydrogen pure from one stage of separation by the thorough condensation of the hydrocarbons in the single-stage separator 20. The net gas overhead stream may possess a hydrogen purity of at least 94 mol %, suitably at least 95 mol %, preferably at least 96 mol % and most preferably at least 96.5 mol % molecular hydrogen. A hydrogen recycle line 25 may recycle through a valve thereon a portion of the net gas in the separator overhead line 22 to a reactor feed stream in line 6 to provide hydrogen requirements for the dehydrogenation reaction. The net gas overhead stream in the separator overhead line 22 can be routed to the main cryogenic heat exchanger 16 to be heated by passing it through a separator overhead pass 23 and provide a product hydrogen stream that can be used elsewhere in the refinery or plant. The separator overhead pass 23 may be in direct downstream communication with the separator overhead line 22 of the single-stage separator 20. The warmed off-gas stream may be provided at a temperature of about 32° C. (90° F.) to about 60° C. (140° F.) and a gauge pressure of about 760 kPa (110 psig) to about 1.2 MPa (170 psig).

The separator bottoms stream is rich in hydrocarbons that can be refined for valuable products. The separator bottoms stream in the separator bottoms line 24 may be pumped at a flow rate controlled using a valve thereon. 26 The separator bottoms stream is heated by passing it through a deethanizer feed pass 27 in the main cryogenic heat exchanger 16 to provide a deethanizer feed stream in a deethanizer feed line 28.

The deethanizer feed stream in line 28 comprises C2 hydrocarbons including ethane and C3 hydrocarbons including propane which must be separated from each other.

Hence, the deethanizer feed stream in line 28 at a temperature between about −31° C. (−25° F.) and about −3° C. (25° F.) is passed to a deethanizer column 30 for fractionation. An optional polypropylene plant recycle stream in line 29 comprising light ends may be added to the deethanizer feed stream in line 28. The deethanizer column 30 separates the deethanizer feed stream in the deethanizer feed line 28 into a deethanizer overhead stream in a deethanizer overhead line 32 extending from an overhead of the deethanizer column which is rich in C2 hydrocarbons including ethane and a deethanized bottoms stream in a deethanizer bottoms line 34 extending from a bottom of the deethanizer column which is rich in C3 hydrocarbons including propane. The deethanized overhead stream in line 32 is transported to an overhead cryogenic heat exchanger 130 and passed through a deethanizer overhead pass 33 in the cryogenic heat exchanger to be cooled by heat exchange with a second cooled refrigerant stream in a second cooled refrigerant line 134 to condense C3+ hydrocarbons and provide a cooled deethanizer overhead stream in a cooled deethanizer overhead line 35. The deethanizer overhead pass 33 may be in downstream communication with the deethanizer overhead line 32 of the deethanizer column 30. The overhead cryogenic heat exchanger 130 may be in downstream communication with a first refrigerant compressor 66 and/or a second refrigerant compressor 73 and a second cooled refrigerant line 134 as will be described hereinafter.

The cooled deethanizer overhead stream in line 35 is fed to a deethanizer receiver 36. The deethanizer receiver 36 is a separator that separates gas from condensate. The deethanizer receiver 36 may be in downstream communication with the deethanizer overhead pass 33 in the overhead cryogenic heat exchanger 130. The deethanizer receiver operates at a temperature of about −32° C. (−25° F.) to about −60° C. (−75° F.) and a gauge pressure of about 690 kPa (100 psig) to about 1.1 MPa (160 psig). A deethanized off-gas stream in a deethanizer receiver overhead line 38 extending from an overhead of the deethanizer receiver 36 carries the off-gas stream which is rich in C2− hydrocarbons back to the overhead cryogenic heat exchanger 130. The overhead cryogenic heat exchanger 130 is in downstream communication with the deethanizer overhead line 32. The off-gas stream in the deethanizer receiver overhead line 38 is heated by heat exchange in an off-gas pass 39 through the overhead cryogenic heat exchanger 130 to provide a warmed off-gas stream and further cool the deethanizer overhead stream in line 32. The warmed off gas stream may be provided at a temperature of about −32° C. (90° F.) to about 60° C. (140° F.) and a gauge pressure of about 690 kPa (100 psig) to about 1.1 MPa (160 psig).

The deethanized bottoms stream in the deethanizer bottoms line 34 which is rich in C3+ hydrocarbons may extend from a bottom of the deethanizer column and be split into two or three streams. A net deethanized bottoms stream may be taken as a splitter feed stream in a net deethanizer bottoms line 40 from the deethanized bottoms stream in line 34. The splitter feed stream comprising propylene and propane may be transported in the net deethanizer bottoms line 40 to a propylene-propane splitter column 50. The propylene-propane splitter column 50 may be in downstream communication with the deethanizer bottoms line 34. A first reboil deethanized bottom stream may be taken in a first reboil deethanized bottoms line 42 from the deethanized bottoms stream in line 34 and passed through a first side of a first deethanizer reboiler heat exchanger 44, boiled up by heat exchange with a vapor refrigerant stream on a second side of the first deethanizer reboil heat exchanger to provide a cool refrigerant stream in line 70 and a first reboiling deethanized bottom stream that is returned boiling to a lower end of the deethanizer column 30. The cool refrigerant steam in line 70 is at least partially liquid. The first side of the first deethanizer reboil heat exchanger 44 may be in downstream communication with the deethanizer bottoms line 34. The second side of the first deethanizer reboil heat exchanger may be in downstream communication with a refrigerant separator overhead line 102 and/or a first refrigerant compressor 66 and perhaps a second refrigerant compressor 68 and/or a second refrigerant pass 63 through the main cryogenic heat exchanger 16 all to be described hereinafter.

In an embodiment, a second reboil deethanized bottom stream may be taken in a second reboil deethanized bottoms line 46 from the deethanized bottoms stream in line 34 and passed through a first side of a second deethanizer reboil heat exchanger 48, boiled up by heat exchange with a second compressed splitter overhead stream in a second splitter overhead line 58 to be described hereinafter in a second side of the second deethanizer reboil heat exchanger and returned to a lower end of the deethanizer column 30. The first side of the second deethanizer reboil exchanger 48 may be in downstream communication with the deethanizer bottoms line 34 and a second side of the deethanizer reboil exchanger may be in downstream communication with a splitter compressor 53. The deethanizer may operate at a bottoms temperature of about 16° C. (50° F.) to about 43° C. (120° F.) and a gauge bottoms pressure of no more than about 1.7 MPa (250 psig) preferably between about 690 kPa (100 psig) to about 1.4 MPa (200 psig).

The cool refrigerant stream transported in a refrigerant line 70 from the second side of the first deethanizer reboil heat exchanger 44 may be split into two streams, a first cooled refrigerant stream in a first cooled refrigerant line 132 and the second cooled refrigerant stream taken in the second cooled refrigerant line 134. The first cooled refrigerant stream in the first cooled refrigerant line 132 may be mixed with a cooled liquid refrigerant stream in line 72 and fed to the main cryogenic heat exchanger 16 in a combined refrigerant line 60 to be cooled. The main cryogenic heat exchanger 16 may be in downstream communication with the first cooled refrigerant line 132 and the first refrigerant compressor 66 and/or the second refrigerant compressor 73 as will be described.

The cryogenic heat exchanger 16 operates with a refrigerant stream that may comprise a mixed refrigerant stream comprising an inert gas and some or all of C1 to C5 hydrocarbons. The mixed refrigerant composition may comprise about 0 to about 7 mol % inert gas, about 11 to about 35 mol % methane, about 25 to about 40 mol % C2 hydrocarbon, about 20 to about 50 mol % C3 hydrocarbon and about 0 to about 15 mol % C5 hydrocarbon in the present disclosure which constitutes a double loop passage of the refrigerant stream through the main cryogenic heat exchanger 16 and the overhead cryogenic heat exchanger 130. If the refrigerant stream is only passed through the main cryogenic heat exchanger 16 in a single loop, the mixed refrigerant composition may comprise about 3 to about 7 mol % inert gas, about 11 to about 15 mol % methane, about 30 to about 40 mol % C2 hydrocarbon, about 30 to about 50 mol % C3 hydrocarbon and about 0 to about 8 mol % C5 hydrocarbon. The inert gas is preferably nitrogen. The C2 hydrocarbon may be ethane or ethylene, and the C3 hydrocarbon may be propane or propylene. The C5 hydrocarbon is preferably isopentane.

The refrigerant stream is passed by the combined refrigerant line 60 through a first refrigerant pass 61 in the main cryogenic heat exchanger 16. In line 60 before the first refrigerant pass 61, the refrigerant may be at a temperature of about 16° C. (60° F.) to about 43° C. (110° F.) and a gauge pressure of about 3.3 MPa (485 psig) to about 3.9 MPa (565 psig). In the first refrigerant pass 61, the refrigerant stream is cooled by heat exchange with other streams in the cryogenic heat exchanger 16 and exits the cryogenic heat exchanger. The first refrigerant pass 61 of the combined refrigerant line 60 in the cryogenic heat exchanger 16 may be in downstream communication with the second side of the first deethanizer reboil exchanger 44. The cooled refrigerant stream is expanded and vaporized in the refrigerant expander 62 cooling it to provide a cold refrigerant stream at a temperature of about −67° C. (−90° F.) to about −101° C. (−150° F.) and a gauge pressure of about 310 kPa (45 psig) to about 1 MPa (140 psig). The refrigerant expander 62 may be a hydraulic recovery turbine for recovery of energy from the expansion. The cold refrigerant stream is passed in the cryogenic heat exchanger 16 through a second refrigerant pass 63 to cool all the other streams passing through the cryogenic heat exchanger while warming the cold refrigerant stream. The second refrigerant pass 63 of the combined refrigerant line 60 in the cryogenic heat exchanger 16 may be in downstream communication with the refrigerant expander 62. The warmed refrigerant stream may be at a temperature of about 10° C. (50° F.) to about 54° C. (130° F.) and a gauge pressure of about 276 kPa (40 psig) to about 931 kPa (135 psig) when it exits the cryogenic heat exchanger after the second refrigerant pass 63 in a warmed refrigerant line 64.

The warmed refrigerant stream exiting the cryogenic heat exchanger 16 in line 64 from the second refrigerant pass 63 is at low pressure and vaporous. Hence, the initial refrigerant stream is subjected to compression to boost its pressure. The warmed, initial refrigerant stream in line 64 may be separated in a first knock out drum 65 to provide a first compression stream in a first knock out overhead line 69 and a first compression liquid stream in the first compression bottoms line 71. The first compression stream in line 69 is compressed by a first refrigerant compressor 66 to provide an intermediate compressed refrigerant stream in line 82 and cooled in a cooler 67 to provide a cooled, intermediate compressed refrigerant stream. The cooled, intermediate compressed refrigerant stream in line 82 may be separated with a warmed expanded second refrigerant stream in line 143 in a second knock out drum 73 to provide a compression stream in a second knock out overhead line 75 and a compression liquid stream in a second compression bottoms line 77. The second compression stream in line 75 is compressed by a second refrigerant compressor 68 to provide a compressed refrigerant stream in a compressed refrigerant line 74. The compressed refrigerant stream in line 74 may be at a temperature of about 107° C. (225° F.) to about 152° C. (275° F.) and a gauge pressure of about 4.5 MPa (650 psig) to about 5.2 MPa (750 psig). It is envisioned that the mixed refrigerant compression could be conducted in one or more than two stages.

To cool the compressed refrigerant stream in line 74 it may be heat exchanged with a depropanizer side stream in a depropanizer side line 76 in a depropanizer upper reboiler heat exchanger 78 to provide a cooled compressed refrigerant stream in a cooled compressed refrigerant line 80 and a heated depropanizer side stream in a depropanizer return line 82. The depropanizer upper reboiler heat exchanger 78 has a first side in communication with the depropanizer side line 76 from a depropanizer column 90 and a second side in communication with the compressed refrigerant line 74. The second side of said depropanizer upper reboiler heat exchanger is in downstream communication with the first refrigerant compressor 66 and/or the second refrigerant compressor 68. A valved bypass is provided on the compressed refrigerant line 74 to the cooled compressed refrigerant line 80 to regulate the amount of heating across the upper depropanizer reboiler heat exchanger 78.

The cooled compressed refrigerant stream in the cooled compressed refrigerant line 80 may be further cooled in an air cooler and passed to a refrigerant separator 100 along with the liquid streams from the first knock out drum 65 in line 71 and the second knock out drum 73 in line 77. The first compression refrigerant liquid stream in the first compression bottoms line 71 and the second compression refrigerant liquid stream in the second compression bottoms line 77 can be transported as a combined compression refrigerant liquid stream in a combined compression line 84 to the refrigerant separator 100. The refrigerant separator 100 separates the combined compression liquid stream in the combined compression line 84 with the cooled compressed refrigerant stream in the cooled compressed refrigerant line 80 into the vapor refrigerant stream in an overhead refrigerant line 102 extending from an overhead of the refrigerant separator and a liquid refrigerant stream in a bottoms refrigerant line 104 extending from a bottom of the refrigerant separator. The refrigerant separator 100 may be in downstream communication with a second side of the depropanizer upper reboiler heat exchanger 78. The vapor refrigerant stream in the overhead refrigerant line 102 may be further cooled by passing it through the second side of the first deethanizer reboil heat exchanger 44 for heat exchange with the first reboil deethanized bottom stream in line 42 passed through the first side of the first deethanizer reboil heat exchanger 44. The second side of the first deethanizer reboil heat exchanger 44 may be in downstream communication with the refrigerant separator overhead line 102. The cool refrigerant stream is transported in the cool refrigerant line 70 to be split into the first cooled refrigerant stream in the first cooled refrigerant line 132 and a second cooled refrigerant stream in the second cooled refrigerant line 134. The first cooled refrigerant stream in line 132 returns back from the first deethanizer reboil exchanger 44 to reconstitute the combined refrigerant stream in the combined refrigerant line 60 to restart the cycle thereby completing the first refrigerant loop. A valved bypass is provided on the overhead refrigerant line 102 to regulate the amount of heat exchange across the first deethanizer reboiler heat exchanger 44. A second refrigerant loop may be constituted by the second cooled refrigerant line 134.

The second cooled refrigerant stream in the second cooled refrigerant line 134 is fed to the overhead cryogenic heat exchanger 130 to cool the deethanizer overhead stream in line 32 and perhaps the deethanizer off-gas stream in the deethanizer receiver overhead line 38. In line 134 before the second cool refrigerant pass 136, the refrigerant may be at a temperature of about 16° C. (60° F.) to about 43° C. (110° F.) and a gauge pressure of about 3.3 MPa (485 psig) to about 4.1 MPa (600 psig). The second cooled refrigerant stream in the second cooled refrigerant line 134 may actually be cooled in a first refrigerant pass 136 through the overhead cryogenic heat exchanger 130. However, the second cooled refrigerant stream in the second cooled refrigerant line 134 exits the overhead cryogenic heat exchanger 130 and is expanded across an expansion valve 138 causing it to vaporize and cool to provide an expanded second cooled refrigerant stream in an expanded second cooled refrigerant line 140. The expansion valve 138 may be a hydraulic recovery turbine for recovery of energy from the expansion and pressure let down. The expanded second cooled refrigerant stream may be at a temperature of about −67° C. (−90° F.) to about −101° C. (−150° F.) and a gauge pressure of about 310 kPa (45 psig) to about 1.7 MPa (250 psig). The expanded second cooled refrigerant stream in line 140 passes back through the overhead cryogenic heat exchanger 130 in a second refrigerant pass 142 and cools all other streams passing through the overhead cryogenic heat exchanger 130 and is fed to the second knock out drum 73 in line 143. The expanded second cooled refrigerant stream in the second refrigerant pass 142 of line 140 cools the second cooled refrigerant stream in the first refrigerant pass 136 of the second cooled refrigerant line 134, the deethanized overhead stream in the pass 33 of the deethanizer overhead line 32 and the off-gas stream in the pass 39 of the deethanizer receiver overhead line 38. The overhead cryogenic heat exchanger 130 may be in downstream communication with the deethanizer receiver overhead line 38. The expanded second cooled refrigerant stream is warmed in the second refrigerant pass 142 of line 140 and exits the overhead cryogenic heat exchanger 130 as a warmed expanded second refrigerant stream in line 143. The warmed expanded second refrigerant stream may be at a temperature of about 10° C. (50° F.) to about 54° C. (130° F.) and a gauge pressure of about 276 kPa (40 psig) to about 931 kPa (135 psig) when it exits the overhead cryogenic heat exchanger 130 in line 143 after the second refrigerant pass 142 of line 140.

The warmed expanded second refrigerant stream in line 143 is separated with the cooled, intermediate compressed refrigerant stream in line 82 in the second knock out drum 73 to provide the compression stream in a second knock out overhead line 75 and the compression liquid stream in the second compression bottoms line 77.

Because the refrigerant stream is passed through the main cryogenic heat exchanger 16 in one loop and to the overhead cryogenic heat exchanger 130 in a second loop, the mixed refrigerant composition may comprise about 25 to about 35 mol % methane, about 25 to about 40 mol % C2 hydrocarbon, about 20 to about 35 mol % C3 hydrocarbon and about 5 to about 15 mol % C5 hydrocarbon. Inert gas may be absent in the composition. The C2 hydrocarbon may be ethane or ethylene, and the C3 hydrocarbon may be propane or propylene. The C5 hydrocarbon is preferably isopentane.

The liquid refrigerant stream in the bottoms refrigerant line 104 also has heat that can be recovered. The liquid refrigerant stream in line 104 may be heat exchanged with a combined net splitter bottoms stream to heat the combined net splitter bottoms stream in a combined net splitter bottoms line 124 in a selective hydrogenation feed exchanger 108. A first side of the selective hydrogenation feed exchanger 108 may be in downstream communication with the net splitter bottoms line 106 and a second side may be in downstream communication with the refrigerant separator bottoms line 104. A valved bypass is provided on the bottoms refrigerant line 104 to regulate the amount of heat exchange across the selective hydrogenation feed exchanger 108. The cooled liquid refrigerant stream in a liquid refrigerant line 72 is transported from the selective hydrogenation feed exchanger 108 back to reconstitute the combined refrigerant stream in line 60 with the first cooled refrigerant stream in line 132 to restart the refrigeration cycle. Cooling of the refrigerant stream in the combined refrigerant line 60 is conducted in the main cryogenic heat exchanger 16.

The splitter feed stream in line 40 comprises propane and propylene that must be separated to obtain the propylene product and recycle propane to the reactor 4. The propylene-propane splitter column 50 fractionates the splitter feed stream into a splitter overhead stream rich in propylene in a splitter overhead line 52 extending from an overhead of the splitter column and a splitter bottoms stream rich in propane in a splitter bottoms line 54 extending from a bottom of the splitter column. The splitter overhead stream is compressed in a splitter compressor 53 which serves to condense the splitter overhead stream and provide a compressed splitter overhead stream in a compressed splitter line 55. The splitter compressor 53 may be in downstream communication with the splitter overhead line 52. The compressed splitter overhead stream in line 55 may be further cooled by a cooling water heat exchanger. The compressed splitter overhead stream in line 55 may exhibit a temperature of about 48° C. (80° F.) to about 71° C. (160° F.) and a gauge pressure of about 1.2 MPa (175 psig) to about 1.9 MPa (275 psig). After heat exchange the temperature of the compressed splitter overhead stream may be reduced by about 3° C. (5° F.) to about 6° C. (10° F.).

A first compressed splitter overhead stream in a first compressed splitter overhead line 56 is taken from the compressed splitter overhead stream in line 55. A second compressed splitter overhead stream in a second compressed splitter overhead line 58 is taken from the compressed splitter overhead stream in line 55. The second deethanized bottoms stream in the second deethanized bottoms line 46 is reboiled by heat exchange with said second compressed splitter overhead stream in line 58 in the second deethanizer reboil heat exchanger 48. A first side of the second deethanizer reboil heat exchanger 48 may be in downstream communication with the deethanizer bottoms line 34 and a second side of the second deethanizer reboil heat exchanger 48 may be in downstream communication with the splitter compressor 53. The heat exchange in the second deethanizer reboil heat exchanger 48 serves to cool the second compressed splitter overhead stream in line 58. A propylene product stream in line 59 may be taken from the cooled second compressed splitter overhead stream in line 58, and a second reflux splitter overhead stream in a second reflux splitter line 110 may be refluxed as a second reflux stream to the propylene splitter column 50 at compression pressure.

A reboil splitter bottoms stream is taken in a reboil splitter bottoms line 112 from the splitter bottoms stream in the splitter bottoms line 54 and reboiled by heat exchange with the first compressed splitter overhead stream in the first compressed splitter bottoms line 56 in a splitter reboil heat exchanger 114. The splitter reboil heat exchanger 114 has a first side in downstream communication with the splitter bottoms line 54 and a second side in downstream communication with the splitter compressor 53. The first compressed splitter overhead stream in the first compressed splitter bottoms line 56 cooled by heat exchange with the reboil splitter bottoms stream in line 112 in the splitter reboil heat exchanger 114 is returned as a first reflux stream to the splitter column 50 at compression pressure. The splitter bottoms stream in line 54 may exhibit a temperature of about 21° C. (70° F.) to about 32° C. (90° F.) and a gauge pressure of about 62 kPa (90 psig) to about 1034 kPa (150 psig).

A net splitter bottoms stream is taken in the net splitter bottoms line 106 from the splitter bottoms stream. The net splitter bottoms stream is rich in propane and may be recycled to the reactor 4. However, diolefins and acetylenes may injure the dehydrogenation catalyst and should be converted to monoolefins in a selective hydrogenation reactor 120. Accordingly, hydrogen from a hydrogen stream 122 is added to the net splitter bottoms stream to provide a combined net splitter bottoms stream in line 124 that is heated in the selective hydrogenation feed heat exchanger 108. The combined net splitter bottoms stream in the combined net splitter bottoms line 124 may be heat exchanged in the selective hydrogenation feed heat exchanger 108 with the liquid refrigerant stream in the bottoms refrigerant line 104 and charged to the selective hydrogenation reactor 120.

The combined net splitter bottoms stream is selectively hydrogenated in the presence of hydrogen and a selective hydrogenation catalyst in the selective hydrogenation reactor 120. The selective hydrogenation reactor 120 is normally operated at relatively mild hydrogenation conditions. These conditions will normally result in the hydrocarbons being present as liquid phase materials, so reactants will normally be maintained under the minimum pressure sufficient to maintain the reactants as liquid phase hydrocarbons. A broad range of suitable operating gauge pressures therefore extends from about 276 kPa (40 psig) to about 5516 kPa (800 psig) or about 345 kPa (50 psig) to about 2069 kPa (300 psig). A relatively moderate temperature between about 25° C. (77° F.) and about 350° C. (662° F.), or between about 50° C. (122° F.) and about 200° C. (392° F.) is typically employed. The liquid hourly space velocity of the reactants through the selective hydrogenation catalyst should be above about 1.0 $hr^{-1}$ and about 35.0 $hr^{-1}$. To avoid the undesired saturation of a significant amount of monoolefinic hydrocarbons, the mole ratio of hydrogen to diolefinic hydrocarbons in the combined net splitter bottoms stream entering the bed of selective hydrogenation catalyst is maintained between 0.75:1 and 1.8:1. Any suitable catalyst which is capable of selectively hydrogenating diolefins may be used. Suitable catalysts include, but are not limited to, a catalyst comprising copper and at least one other metal such as titanium, vanadium, chrome, manganese, cobalt, nickel, zinc, molybdenum, and cadmium or mixtures thereof. The metals are preferably supported on inorganic oxide supports such as silica and alumina, for example.

A selectively hydrogenated net splitter bottom stream comprising propane is transported in a hydrogenated effluent line 126 perhaps after gas separation and added to a fresh propane feed stream in line 128 and both are fed to the depropanizer column 90. The depropanizer column 90 may be in downstream communication with the splitter bottoms line 54. The depropanizer column 90 separates the selectively hydrogenated net splitter bottoms stream and the fresh propane feed stream to provide a depropanizer overhead stream rich in propane in an overhead line 92 extending from an overhead of the depropanizer column and a depropanized bottoms stream rich in C4+ hydrocarbons in a depropanizer bottoms line 94 extending from a bottom of the depropanizer column.

The depropanizer overhead stream in the depropanizer overhead line 92 is cooled and may be fully condensed and fed to a depropanizer receiver 93. A receiver bottoms stream exits the bottom of the depropanizer receiver in a depropanizer receiver bottoms line 95. A depropanizer reflux stream taken from the depropanizer receiver bottoms line 95 refluxes condensed propane back to the depropanizer column 90. The depropanizer receiver 93 operates at a temperature of about 20° C. (68° F.) to about 70° C. (158° F.) and a gauge pressure of about 1.4 MPa (200 psig) to about 1.8 MPa (261 psig).

A depropanizer net overhead stream in a net depropanizer overhead line 96 is expanded across a depropanizer overhead expander 86 to vaporize and cool it, supplemented with hydrogen from the hydrogen recycle line 25, and further cooled in a reactor feed pass 88 in the main cryogenic heat exchanger 16 to provide the reactor feed stream in the reactor feed line 2. The depropanizer overhead expander 86 may be a hydraulic recovery turbine for recovery of energy from the expansion. The hydrogen-to-hydrocarbon molar ratio of the reactor feed stream in the range of 0.005 to 0.6 is controlled by the control valve on the hydrogen recycle line 25.

The reactor feed stream in the reactor feed line 2 exiting the reactor feed pass 88 may be provided to the dehydrogenation reactor 4 at a temperature of about 32° C. (90° F.) to about 60° C. (140° F.) and a gauge pressure of about 69 kPa (10 psig) to about 0.5 MPa (80 psig).

A depropanizer side stream taken in a depropanizer side line 76 from the depropanizer 90 may be reboiled in a depropanizer upper reboiler heat exchanger 78 by heat exchange with the compressed refrigerant stream in line 74 to provide a cooled compressed refrigerant stream in line 80 and a heated depropanizer side stream in line 82, which is returned to the depropanizer column 90 through its side as a vapor stream. The depropanizer side stream taken in line 76 is suitably a liquid stream taken from a liquid trap in the depropanizer column 90.

The depropanizer bottoms stream in the depropanizer bottoms line 94 is rich in C4+ hydrocarbons. A depropanizer reboil stream taken in line 97 from the depropanizer bottoms stream in line 94 may be heated in a depropanizer reboil heat exchanger 99 and returned to a lower end of the depropanizer column 90. A net depropanizer bottoms stream comprising C4+ hydrocarbons may be taken in a net depropanizer bottoms line 98 as product. The depropanizer column 90 operates at a bottoms temperature of about 80° C. (176° F.) to about 130° C. (195° F.) and a gauge pressure of about 1.5 MPa (217 psig) to about 2 MPa (290 psig).

The process and apparatus make use of a single mixed refrigerant composition to provide cooling duty to all of the operations. Two cryogenic heat exchangers are able to provide main cooling and cooling for the deethanizer overhead stream to enable sufficient condensation of hydrocarbon streams.

EXAMPLE

We simulated the present process and apparatus for processing 600 kilometric tons of dehydrogenated feed annually and compared its performance to a comparable conventional deethanizer system using cascaded heat exchange to achieve cooling. We achieve the improvements shown in the Table below.

TABLE

| Item | Improvement |
|---|---|
| Capital Expenditure | −14% |
| Operational Expense | −16% |
| Emissions | −25% |
| Equipment Count | −42% |

SPECIFIC EMBODIMENTS

While the following is described in conjunction with specific embodiments, it will be understood that this description is intended to illustrate and not limit the scope of the preceding description and the appended claims.

A first embodiment of the disclosure is a process for separating C2 hydrocarbons from C3 hydrocarbons comprising passing a deethanizer feed stream comprising C2 and C3 hydrocarbons to a deethanizer column to provide a deethanizer overhead stream rich in C2 hydrocarbons and a deethanized bottoms stream rich in C3 hydrocarbons; condensing a deethanizer overhead stream by heat exchange with a refrigerant stream. An embodiment of the disclosure is one, any or all of prior embodiments in this paragraph up through the first embodiment in this paragraph further comprising reboiling a deethanized bottoms stream by heat exchange with the refrigerant stream. An embodiment of the disclosure is one, any or all of prior embodiments in this paragraph up through the first embodiment in this paragraph, wherein the step of condensing the deethanizer overhead stream by heat exchange with the refrigerant stream further comprises compressing an initial refrigerant stream to provide a compressed refrigerant stream, cooling the compressed refrigerant stream into a cool refrigerant stream. An embodiment of the disclosure is one, any or all of prior embodiments in this paragraph up through the first embodiment in this paragraph further comprising expanding the cool refrigerant stream to provide an expanded refrigerant stream and cooling the deethanizer overhead stream by heat exchange with the expanded refrigerant stream. An embodiment of the disclosure is one, any or all of prior embodiments in this paragraph up through the first embodiment in this paragraph further comprising separating the compressed refrigerant stream into a vapor refrigerant stream refrigerant stream and cooling the vaporous refrigerant stream to provide the cool refrigerant stream. An embodiment of the disclosure is one, any or all of prior embodiments in this paragraph up through the first embodiment in this paragraph further comprising reboiling a deethanized bottoms stream by heat exchange with the vapor refrigerant stream to provide a reboiled deethanized bottom stream and a cool refrigerant stream and cooling the deethanizer overhead stream by heat exchange with the cool refrigerant stream. An embodiment of the disclosure is one, any or all of prior embodiments in this paragraph up through the first embodiment in this paragraph further comprising taking a first cooled refrigerant stream from the cool refrigerant stream and cooling a dehydrogenated stream by heat exchange with the first cooled refrigerant stream and taking a second cooled refrigerant stream from the cool refrigerant stream and cooling the deethanizer overhead stream by heat exchange with the second cooled refrigerant stream. An embodiment of the disclosure is one, any or all of prior embodiments in this paragraph up through the first embodiment in this paragraph further comprising compressing an initial refrigerant stream to provide an intermediate compressed stream and compressing the intermediate compressed refrigerant stream to provide a compressed refrigerant stream and reboiling a depropanizer side stream by heat exchange with the compressed refrigerant stream to provide a cooled compressed refrigerant stream. An embodiment of the disclosure is one, any or all of prior embodiments in this paragraph up through the first embodiment in this paragraph wherein the step of separating the compressed refrigerant stream further comprises separating the intermediate compressed refrigerant stream and the cooled compressed refrigerant stream into the vapor refrigerant stream. An embodiment of the disclosure is one, any or all of prior embodiments in this paragraph up through the first embodiment in this paragraph further comprising separating the compressed refrigerant stream into the vapor refrigerant stream and a liquid refrigerant stream and cooling a dehydrogenated stream by heat exchange with the liquid refrigerant stream. An embodiment of the disclosure is one, any or all of prior embodiments in this paragraph up through the first embodiment in this paragraph further comprising separating the compressed refrigerant stream into the vapor refrigerant stream and a liquid refrigerant stream, cooling the vapor refrigerant stream to provide the cool refrigerant stream and cooling a dehydrogenated stream by heat exchange with the cool refrigerant stream and the liquid refrigerant stream.

A second embodiment of the disclosure is a process for separating ethane from propane comprising passing a deethanizer feed stream comprising ethane and propane to a deethanizer column to provide a deethanizer overhead stream rich in ethane and a deethanized bottoms stream rich in propane; reboiling a deethanized bottoms stream by heat exchange with a refrigerant stream; condensing a deethanizer overhead stream by heat exchange with the refrigerant stream. An embodiment of the disclosure is one, any or all of prior embodiments in this paragraph up through the second embodiment in this paragraph, wherein the step of condensing the deethanizer overhead stream by heat exchange with the refrigerant stream further comprises compressing an initial refrigerant stream to provide a compressed refrigerant stream, separating the compressed refrigerant stream into a vapor refrigerant stream, cooling the vapor refrigerant stream to provide a cool refrigerant stream and cooling the deethanizer overhead stream by heat exchange with the cool refrigerant stream to provide a cooled deethanizer overhead stream. An embodiment of the disclosure is one, any or all of prior embodiments in this paragraph up through the second embodiment in this paragraph further comprising expanding the cool refrigerant stream to provide an expanded refrigerant stream and cooling the deethanizer overhead stream by heat exchange with the expanded refrigerant stream. An embodiment of the disclosure is one, any or all of prior embodiments in this paragraph up through the second embodiment in this paragraph further comprising reboiling a deethanized bottoms stream by heat exchange with the vapor refrigerant stream to provide a reboiled deethanized bottom stream and the cool refrigerant stream and cooling the deethanizer overhead stream by heat exchange with the cool refrigerant stream. An embodiment of the disclosure is one, any or all of prior embodiments in this paragraph up through the second embodiment in this paragraph further comprising taking a first cooled refrigerant stream from the cool refrigerant stream and cooling a dehydrogenated stream by heat exchange with a first cooled refrigerant stream and taking a second cooled refrigerant stream from the cool refrigerant stream and cooling the deethanizer overhead stream by heat exchange with the second cooled refrigerant stream. An embodiment of the disclosure is one, any or all of prior embodiments in this paragraph up through the second embodiment in this paragraph further comprising separating the compressed refrigerant stream into the vapor refrigerant stream and a liquid refrigerant stream and cooling a dehydrogenated stream by heat exchange with the liquid refrigerant stream.

A third embodiment of the disclosure is an apparatus for recovering dehydrogenated effluent comprising a first heat exchanger for cooling a dehydrogenated stream in downstream communication with a dehydrogenation reactor; a second heat exchanger for cooling a deethanized overhead stream in downstream communication with a deethanizer overhead line; a refrigerant compressor; the first heat exchanger and the second heat exchanger in downstream communication with the refrigerant compressor. An embodiment of the disclosure is one, any or all of prior embodiments in this paragraph up through the third embodiment in this paragraph further comprising a reboil heat exchanger in downstream communication with the refrigerant compressor. An embodiment of the disclosure is one, any or all of prior embodiments in this paragraph up through the third embodiment in this paragraph wherein the second heat exchanger is in downstream communication with the deethanizer receiver overhead line.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for separating C2 hydrocarbons from C3 hydrocarbons comprising:

passing a deethanizer feed stream comprising C2 and C3 hydrocarbons to a deethanizer column to provide a deethanizer overhead stream rich in C2 hydrocarbons and a deethanized bottoms stream rich in C3 hydrocarbons;

compressing an initial refrigerant stream to provide a compressed refrigerant stream and separating said compressed refrigerant stream into a vapor refrigerant stream refrigerant stream;

reboiling a deethanized bottoms stream by heat exchange with said vapor refrigerant stream to provide a reboiled deethanized bottom stream and a cool refrigerant stream; and cooling said deethanizer overhead stream by heat exchange with said cool refrigerant stream.

2. The process of claim 1 further comprising reboiling a deethanized bottoms stream by heat exchange with said refrigerant stream.

3. The process of claim 1 further comprising expanding said cool refrigerant stream to provide an expanded refrigerant stream and cooling said deethanizer overhead stream by heat exchange with said expanded refrigerant stream.

4. The process of claim 1 further comprising taking a first cooled refrigerant stream from said cool refrigerant stream and cooling a dehydrogenated stream by heat exchange with said first cooled refrigerant stream and taking a second cooled refrigerant stream from said cool refrigerant stream and cooling said deethanizer overhead stream by heat exchange with said second cooled refrigerant stream.

5. The process of claim 1 further comprising compressing an initial refrigerant stream to provide an intermediate compressed stream and compressing said intermediate compressed refrigerant stream to provide a compressed refrigerant stream and reboiling a depropanizer side stream by heat exchange with said compressed refrigerant stream to provide a cooled compressed refrigerant stream.

6. The process of claim 5 wherein said step of separating said compressed refrigerant stream further comprises separating said intermediate compressed refrigerant stream and said cooled compressed refrigerant stream into said vapor refrigerant stream.

7. The process of claim 1 further comprising separating said compressed refrigerant stream into said vapor refrigerant stream and a liquid refrigerant stream and cooling a dehydrogenated stream by heat exchange with said liquid refrigerant stream.

8. The process of claim 1 further comprising separating said compressed refrigerant stream into said vapor refrigerant stream and a liquid refrigerant stream, cooling said vapor refrigerant stream to provide said cool refrigerant stream and cooling a dehydrogenated stream by heat exchange with said cool refrigerant stream and said liquid refrigerant stream.

9. A process for separating ethane from propane comprising:

passing a deethanizer feed stream comprising ethane and propane to a deethanizer column to provide a deethanizer overhead stream rich in ethane and a deethanized bottoms stream rich in propane;

reboiling a deethanized bottoms stream by heat exchange with a refrigerant stream;

compressing an initial refrigerant stream to provide a compressed refrigerant stream, separating said compressed refrigerant stream into a vapor refrigerant stream and a liquid refrigerant stream; and cooling a dehydrogenated stream by heat exchange with said liquid refrigerant stream.

10. The process of claim 9 further comprising expanding said cool refrigerant stream to provide an expanded refrigerant stream and cooling said deethanizer overhead stream by heat exchange with said expanded refrigerant stream.

11. The process of claim 9 further comprising reboiling a deethanized bottoms stream by heat exchange with said vapor refrigerant stream to provide a reboiled deethanized bottom stream and said cool refrigerant stream and cooling said deethanizer overhead stream by heat exchange with said cool refrigerant stream.

12. The process of claim 11 further comprising taking a first cooled refrigerant stream from said cool refrigerant stream and cooling a dehydrogenated stream by heat exchange with a first cooled refrigerant stream and taking a second cooled refrigerant stream from said cool refrigerant stream and cooling said deethanizer overhead stream by heat exchange with said second cooled refrigerant stream.

13. An apparatus for recovering dehydrogenated effluent comprising:

a first heat exchanger for cooling a dehydrogenated stream in downstream communication with a dehydrogenation reactor;

a second heat exchanger for cooling a deethanized overhead stream in downstream communication with a deethanizer overhead line;

a refrigerant compressor;

the first heat exchanger and the second heat exchanger in downstream communication with said refrigerant compressor; and a reboil heat exchanger in downstream communication with said refrigerant compressor.

14. The apparatus of claim 13 wherein said second heat exchanger is in downstream communication with said deethanizer overhead line.

* * * * *